United States Patent [19]

Chang

[11] Patent Number: 4,770,297

[45] Date of Patent: Sep. 13, 1988

[54] ASSEMBLING TOOL-HOLDER SET

[76] Inventor: Yen-Nien Chang, P.O. Box 10160, Taipei, Taiwan

[21] Appl. No.: 86,303

[22] Filed: Aug. 17, 1987

[51] Int. Cl.[4] ..... B65D 85/28

[52] U.S. Cl. ..... 206/379; 220/23.4

[58] Field of Search ..... 206/349, 372, 373, 379, 206/443; 220/23.2, 23.4; 211/70.6; 248/547

[56] References Cited

U.S. PATENT DOCUMENTS

| | | | |
|---|---|---|---|
| 1,341,848 | 6/1920 | Haensler | 211/70.6 |
| 3,102,637 | 9/1963 | Scholl, Sr. | 206/379 X |
| 3,131,829 | 5/1964 | Masser | 220/23.4 X |
| 3,194,426 | 7/1965 | Brown, Jr. | 220/23.4 |
| 3,338,452 | 8/1967 | Oakley et al. | 220/23.4 |
| 3,800,974 | 4/1974 | Mogel et al. | 220/23.4 |
| 4,253,830 | 3/1981 | Kazen et al. | 206/379 X |
| 4,410,095 | 10/1983 | Dembicks | 211/70.6 |
| 4,509,651 | 4/1985 | Prindle | 211/70.6 |
| 4,613,042 | 9/1986 | Aeschliman | 206/443 X |

FOREIGN PATENT DOCUMENTS

| | | | |
|---|---|---|---|
| 2619151 | 10/1977 | Fed. Rep. of Germany | 211/70.6 |
| 3306348 | 8/1984 | Fed. Rep. of Germany | 220/23.4 |
| 302565 | 12/1928 | United Kingdom | 248/547 |

*Primary Examiner*—Joseph Man-Fu Moy

[57] ABSTRACT

An assembling tool holder set includes a plurality of tool holder units having differently sized holes formed thereon for inserting differently sized tools and having different heights with respect to the different holes, each tool holder unit formed with extensions and grooves on its side faces so that each holder unit can be engageably combined with any adjacent tool holder units for optionally or selectively assembling several tool units as popularly used for their convenient handling and unconfused uses.

2 Claims, 3 Drawing Sheets

ASSEMBLING TOOL-HOLDER SET

BACKGROUND OF THE INVENTION

Conventional tool holder set as shown in FIG. 1 includes several concentric annular disks each disk drilled with plural holes of gradually increasing or decreasing diameter for inserting a series of tools such as drills or reamers into the relevant holes. However, such a tool holder set has the following defects:

1. When performing a drilling or reaming operation in a factory, the drills or reamers always used are selectively limited as several sizes only and the remaining tools not in use are still inserted in the tool holder set which must be overall removed from a tool warehouse to the working area, thereby causing an operator's inconvenience by carrying such a heavy overall tool set as shown in FIG. 1.

2. If the machine operator intends not to carry such an overall heavy set, he may pick up the few necessary drills or reamers to put aside a drilling machine and those few tools without inserting in the tool holder may be easily damaged, lost or confused in use.

The present inventor has found the defects of a conventional tool holder and invented the present assembling tool-holder set.

SUMMARY OF THE INVENTION

The object of the present invention is to provide an assembling tool-holder set including a plurality of tool holder units having differently sized holes formed thereon for inserting differently sized tools and having different heights with respect to the different holes, each tool holder unit formed with extensions and grooves on its side faces so that each holder unit can be engageably combined with any adjacent tool holder units for optionally or selectively assembling several tool units as popularly used for their convenient handling and unconfused uses.

DETAILED DESCRIPTION

Figure 2:
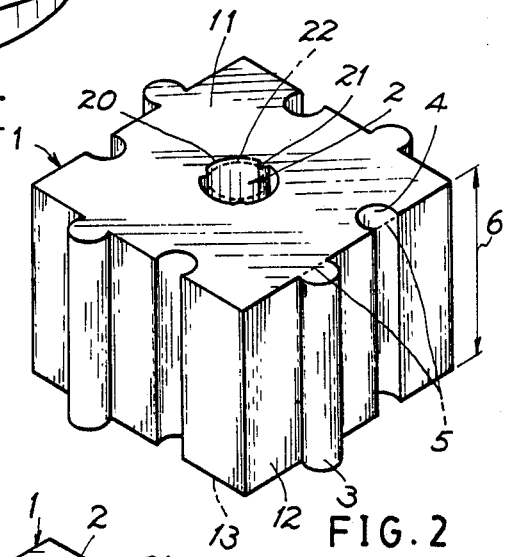
FIG. 2 is a perspective illustration of the present invention.
Figure 3:
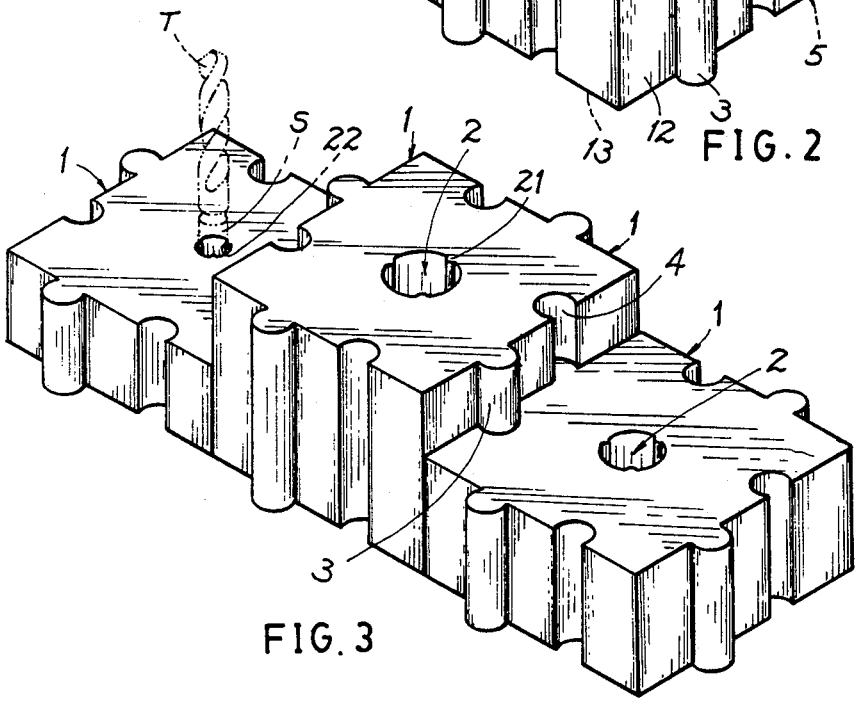
FIG. 3 shows a selective combination by assembling several units of the present invention.
Figure 4:
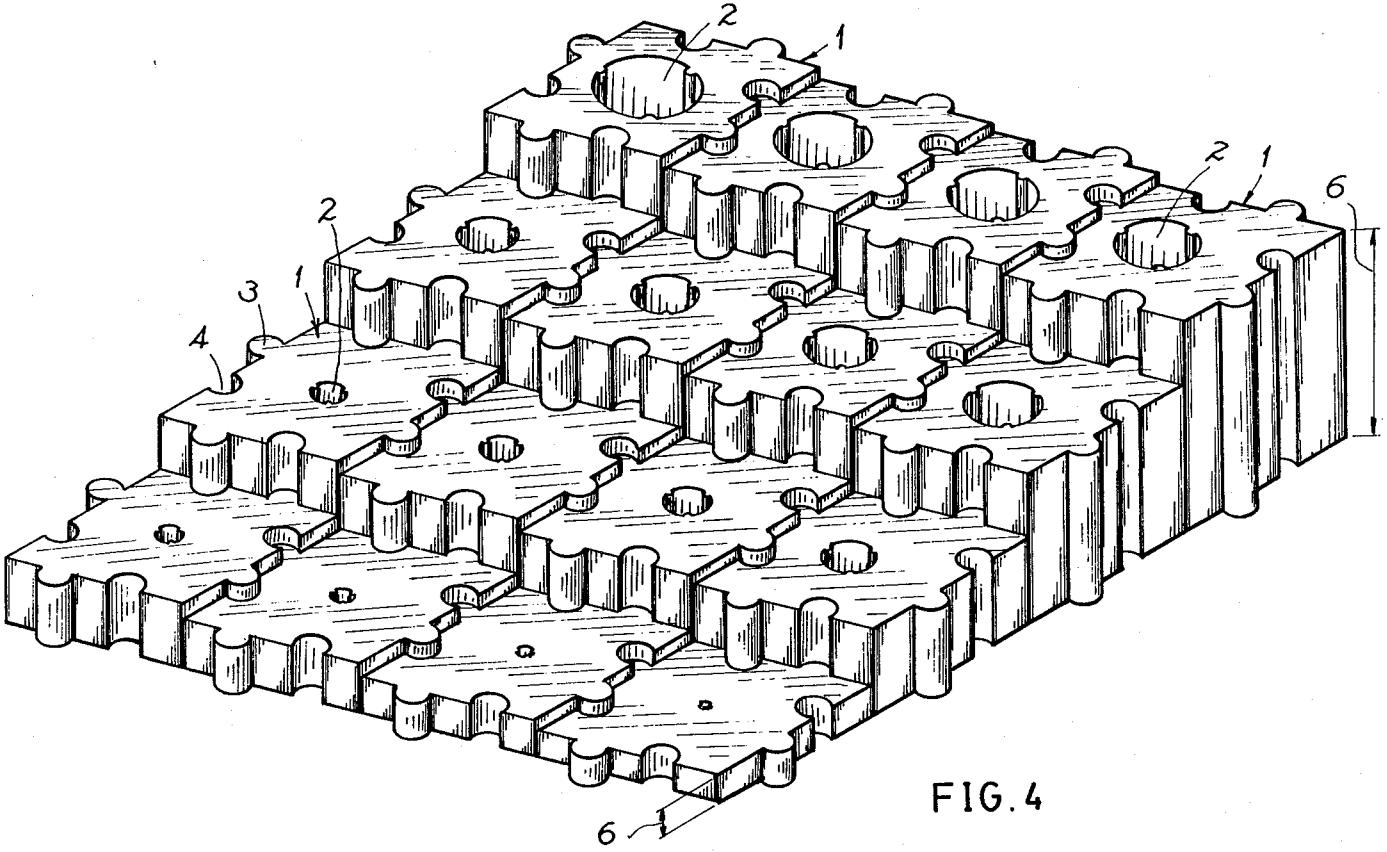
FIG. 4 shows a gigantic combination by assembling plural units of the present invention.

As shown in FIGS. 2–4, the present invention comprises a plurality of tool holder units 1 adapted to be assembled with one another, each tool holder unit 1 formed as a parallelepiped having an upper face 11, a lower face 13 and four side faces 12.

The tool holder unit 1 is formed with a cylindrical hole 2 on a central portion of the upper face 11 adapted for inserting a correspondingly sized tool T and has its each side face 12 juxtaposedly formed with a secant-cylinder extension 3 between upper and lower faces 11, 13 and a longitudinal groove 4 having its recess dimensions equivalent to or slightly smaller than the dimensions of the extension 3.

The extension 3 and groove 4 are so formed on each side face 12 that each chord 5 intersecting a cross section of either extension 3 or groove 4 with the side face 12 is symmetrically disposed on each side face 12, and all extensions 3 and grooves 4 are circumferentially disposed on all side faces 12 in an order that an extension 3 followed by a groove 4 aside the extensions 3 are subsequently repeatedly disposed on all the side faces 12 around an axis of the hole 2 counter-clockwise. In order to ensure a sound vertical engagement of each extension 3 with a corresponding adjacent groove 4 of another unit 1, the cross sectional area of each extension 3 should be larger than a half-circle cross sectional area of a cylinder of the extension 3, i.e., the chord 5 of each extension 3 should be smaller than the diameter of the extension cylinder.

The cylindrical hole 2 formed on the upper face 11 includes several slim longitudinal extensions 21 extending inwardly from a cylindrical wall 20 of the hole 2 to define a hypothetic cylindrical hole 22 as shown in dotted line of FIG. 2 snugly engaged with the shank portion S of each tool T such as a drill, a reamer or other cylindrical tool. It means that the diameter of each cylindrical hole 2 should be slightly larger than a corresponding diameter of the tool T inserted in the hole 2 so as to thoroughly insert a used tool T of which the shank S had been variegated or scaled as clamped by a chuck. A space defined between the cylindrical wall 20 and the slim extensions 21 may provide a storing space for keeping any variegated portion or scale extending on the shank 5 within such a space. The upper or lower face 11 or 12 may be a square.

In using the present invention, if only three differently sized tools are required in a processing operation three units 1 as shown in FIG. 3 are assembled by engaging each extension 3 of an unit 1 with an adjacent corresponding groove 4 of another unit, to thereby be so convenient in carrying such three units and also to prevent confusion in using each tool held in its relevant unit.

Each unit 1 should have a specific height 6 of its side face with respect to the diameter of the cylindrical hole 2 of each unit 1 for the convenient identification of the specific unit 1 having specific sized hole 2. Therefore, a gigantic combination comprised of plural units of the present invention can be assembled as shown in FIG. 4 for subsequently inserting a complete set of tools into the corresponding units 1 arranged in an order by gradually increasing diameters of the holes 2 and heights 6 of the units with respect to the increasing diameters of the tools T. The unit 1 with smaller diameter of hole 2 has a lower height 6, in comparing another unit having larger diameter of hole 2 and larger height 6 of the side face 12.

Figure 5:
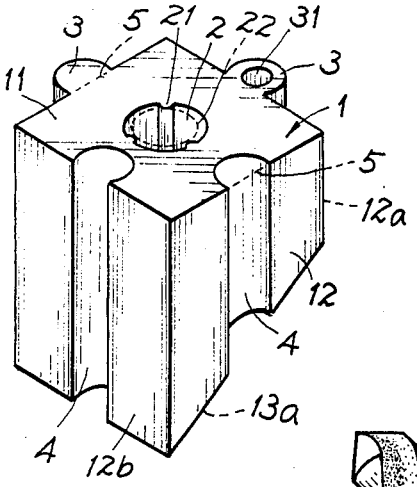
FIG. 5 is a perspective illustration of another preferred embodiment of the present invention.
Figure 6:
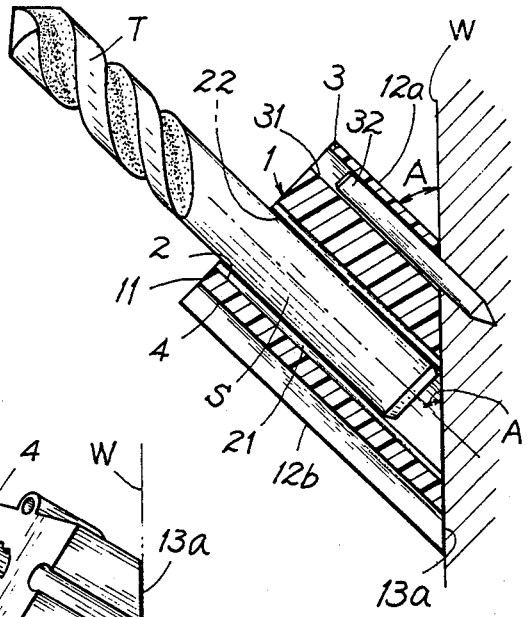
FIG. 6 shows a tool holder unit of the present invention hanged on a wall.
Figure 7:
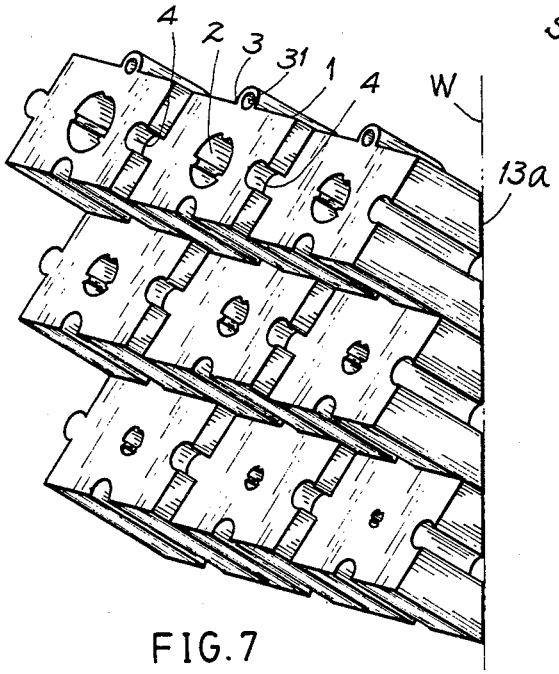
FIG. 7 shows plural units combined altogether and hanged on a wall in accordance with the present invention.

Another preferred embodiment of the present invention is shown in FIGS. 5–7, which comprises a plurality of tool holder units 1 capable of being assembled with one another, each unit 1 formed as a truncated parallelepiped including: an inclined bottom face 13*a* as defined between a short side face 12*a* and a long side face 12*b*, a cylindrical hole 2 formed on an upper face 11 of the unit 1, two secant-cylinder extensions 3 respectively formed on two adjacent side faces 12*a*, 12, two longitudinal grooves 4 each corresponding to each extension 3 respectively formed on the other two adjacent side faces 12 opposite to the two extensions 3, and the short side face 12*a* formed with a through hole 31 on the extension 3 adapted for inserting a nail 32 therethrough to fix the unit 1 on a vertical wall or frame W as shown in FIG. 6. The extension 3 or groove 4 is formed on a central portion of each side face. The axis of the hole 2 and the side face 12*a* each forms an acute angle A with the vertical wall W so as to allow th tool T inserted in the hole 2 posing approximately to an upright condition, preventing its falling down from the holder unit 1 and preventing its possible hurt to an operator. The gigantic combination of the units are assembled and hanged on a wall as shown in FIG. 7.

Figure 1:
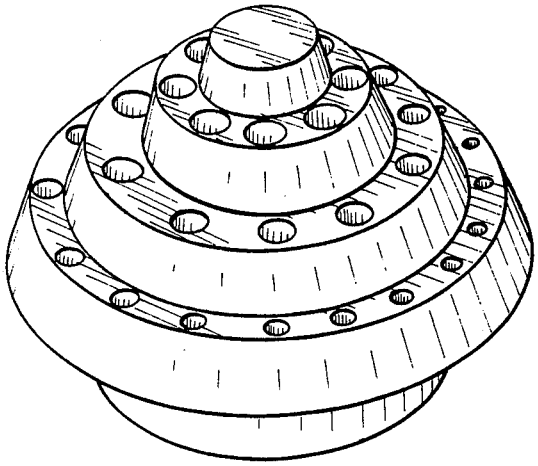
FIG.1 PRIOR ART
FIG. 1 is an illustration showing a conventional tool holder set.

The cylindrical hole 2 of the present invention can be modified to be other shapes of holes, adapted for inserting other tools rather than a cylinder shape. The extension 3 or groove 4 may also be modified to be other shapes rather than a secant-cylinder shape. For example, a polygonal extension and groove can therefore be modified. Meanwhile, the position of either extension or groove as shown in FIG. 1 can be alternated for other choices of design. The shapes of units 1 can also be modified to be other shapes such as a cylinder or a polyhedron.

The units of the present invention are not only applied for plural tools of different diameters. However, if several differently-angled drills with a same diameter are commonly applied for drilling a hole of a work piece, then several units 1 of the present invention having the same diameter of holes 2 may be assembled for processing uses.

By the present invention, the tools such as drills can be systematically arranged, suitable for efficient modern factory management.

I claim:

1. A tool holder set comprising a plurality of tool holder units capable of being assembled with one another, each said tool holder unit formed as a parallelepiped having an upper square face, a lower square face and four side faces; said tool holder unit formed with a hole on a central portion of said upper face adapted for inserting a correspondingly sized tool therein and having its each side face juxtaposedly formed with an extension between said upper and lower faces, and a longitudinal groove equivalent to said extension; a chord intersecting a cross section of each said extension or each said groove with said side face being symmetrically disposed on each said side face; the improvement which comprises: all said extensions and said grooves being circumferentially disposed on all saidside faces in an order that one said extension followed by one said groove aside said extension are subsequently, repeatedly and counterclockewise disposed on all said side faces around an axis of said hole formed on said upper surface, whereby upon the engagement of one extension of one tool holder unit with an adjacent corresponding groove of another unit, plural units are optionally assembled.

2. A tool holder set according to claim 1, wherein each said tool holder unit is formed as a truncated parallelipiped including: an upper square surface, four side faces, an inclined bottom face defined between a short side face and a long side face, a cylindrical hole formed on said upper face of said unit for inserting a tool therein, said holder unit having said extensions and grooves formed on said side faces thereof with all limitations of said extensions and grooves as set forth in claim 1, said short side face formed with a through hole therein for inserting a nail therethrough to fix said unit on a vertical wall, said short side face forming an acute angle with said vertical wall so as to pose a tool inserted in said hole approximately to its upright condition, whereby upon an engagement of said extension with an adjacent corresponding groove of another unit, plural tool holder units are assembled.

* * * * *